US005679028A

United States Patent [19]

Yagi et al.

[11] Patent Number: 5,679,028

[45] Date of Patent: Oct. 21, 1997

[54] DIVISION-TYPE MULTI-POLE CONNECTOR

[75] Inventors: Sakai Yagi; Toru Nagano; Michitaka Kinoshita, all of Shizuoka, Japan

[73] Assignee: Yazaki Corporation, Tokyo, Japan

[21] Appl. No.: 490,737

[22] Filed: Jun. 15, 1995

[30] Foreign Application Priority Data

Jun. 17, 1994 [JP] Japan ..... 6-135970

[51] Int. Cl.[6] ..... H01R 13/502

[52] U.S. Cl. ..... 439/701

[58] Field of Search ..... 439/189, 217–218, 439/364, 701

[56] References Cited

U.S. PATENT DOCUMENTS

| | | | |
|---|---|---|---|
| 4,997,386 | 3/1991 | Kawachi et al. | 439/701 |
| 5,312,268 | 5/1994 | Sumida | 439/701 |
| 5,378,173 | 1/1995 | Hashizawa | 439/701 |
| 5,454,733 | 10/1995 | Watanabe et al. | 439/540.1 |
| 5,545,053 | 8/1996 | Ishii et la. | 439/701 |

FOREIGN PATENT DOCUMENTS

| | | | |
|---|---|---|---|
| 6-310200 | 11/1994 | Japan | H01R 13/518 |

*Primary Examiner*—Neil Abrams
*Assistant Examiner*—Brian J. Biggi
*Attorney, Agent, or Firm*—Sughrue, Mion, Zinn, Macpeak, and Seas

[57] ABSTRACT

Fitting surfaces of female housings mounted on one frame are disposed in a common plane, and fitting surfaces of male housings mounted on the other frame are disposed in a common plane. The position of retaining the housings is disposed a predetermined distance from the fitting surfaces. Another type of female connector housing can be interchangeably mounted in a predetermined cavity in the one frame while another type of male connector housing can be interchangeably mounted in a predetermined cavity in the other frame.

10 Claims, 4 Drawing Sheets

DIVISION-TYPE MULTI-POLE CONNECTOR

BACKGROUND OF THE INVENTION

1. Field of The Invention

This invention relates to a division-type multi-pole connector in which a plurality of sub-connectors are mounted in one frame in an interchangeable manner.

2. Background

As shown in FIG. 7, a conventional division-type multi-pole connector, capable of connecting a plurality of wire harnesses (connected to lamps, windshield wipers, a fuel indicator, a speed indicator and so on mounted in an automobile) together at one region comprises a plurality of sub-connectors (for example, many kinds of male connector housings 30), and a frame 31 having mounting holes (hereinafter referred to as "cavities") 34 each exclusively designed to receive a corresponding one of the male connector housings 30. This frame 31 has a bolt 32 provided at a central portion thereof for being threaded into a bolt hole formed in a mating frame (not shown). By tightening the bolt 32, the two frames are fastened together, so that each mating pair of connector housings of the two frames are electrically connected together.

In the above division-type multi-pole connector, when the number of the sub-connectors to be mounted is reduced depending on the kind or grade of the automobile, the two frames, when threadedly fastened together, become closer to each other to be tilted relative to each other at that portion where the empty cavities are present. As a result, gouging has often developed between the mating sub-connectors attached respectively to the two frames.

Under the circumstances, the Applicant of the present application has earlier proposed a division-type multi-pole connector of the type (see FIG. 8) in which dummy sub-connectors 35 are mounted respectively in those cavities 34 which are empty because of a decreased number of sub-connectors to be mounted, thereby satisfactorily overcoming the above problem.

In the division-type sub-connector, however, it is desirable to positively use such empty cavities rather than to close them by the dummy connectors. Therefore, it may be proposed to mount connectors, used for other circuitry, in the empty cavities, respectively; however, such connectors used for other circuitry are different in outside dimensions and retaining position relative to the frame, and therefore could be utilized.

It may also be proposed to form the frame in accordance with the kind or grade of the automobile, thereby preventing any cavity from being left empty in the division-type multi-pole connector. In this case, however, molds for forming the frames must be newly produced, which has resulted in a problem that the cost is increased.

SUMMARY OF THE INVENTION

The present invention has been made in view of the above problems, and an object of the invention is to provide a division-type multi-pole connector in which different kinds of sub-connectors can be mounted in cavities in a frame, thus imparting a general purpose function to the frame, thereby preventing the cost from increasing.

The above object has been achieved by a division-type multi-pole connector of the present invention wherein a plurality of kinds of female connector housings are mounted in one frame while a plurality of kinds of male connector housings, corresponding respectively to the female connector housings, are mounted in the other frame; CHARACTERIZED in that each of another female connector housing and another male connector housing can be mounted in a predetermined cavity in a respective one of the one and other frames; a fitting surface of each of the another female and male connector housings and fitting surfaces of the other connector housings in the same frame lie in a common plane; and retaining member for retaining each of the another female and male connector housings on the associated frame is disposed a predetermined distance from the fitting surfaces.

Projected ends of the plurality of kinds of female connector housings mounted in the one frame are disposed in the common plane spaced an equal distance from the fitting surfaces.

The retaining member for retaining each of the another female and male connector housings on the associated frame comprises a retaining projection formed on an outer surface of the housing, and an elastic retaining arm formed on the frame.

In the division-type multi-pole connector of the invention, each of the another female and male connector housings can be received in an adapter case, in which case the adapter case is retained relative to the frame.

In the above division-type multi-pole connector, the connector, receiving other type of terminals for other circuit, has a configuration conforming to an open area of the predetermined cavity of the frame for receding the sub-connector, and therefore the connector can be mounted in this predetermined cavity in an interchangeable manner. The male (female) connector housings, mounted in the associated frame, are retained thereon in such a manner that their fitting surfaces are disposed in the common plane even if the interchangeable connector housing is used, and therefore when the two frames are fastened together, the male and female connector housings are satisfactorily fitted together to make electrical connection.

DETAILED DESCRIPTION OF THE PREFERRED EMBODIMENTS

A preferred embodiment of the present invention will now be described with reference to the drawings.

Figure 1:
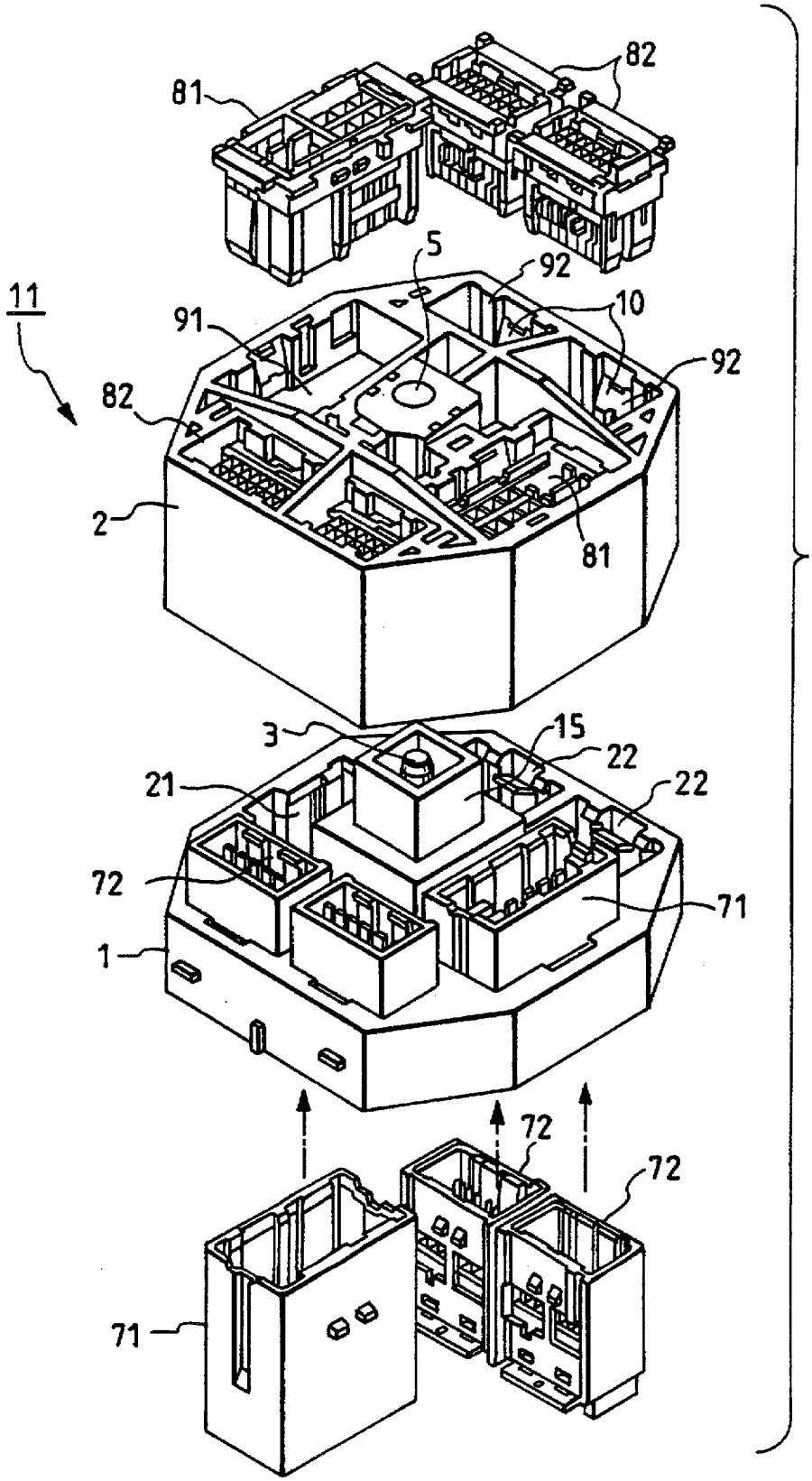
FIG. 1 is an exploded perspective view of one preferred embodiment of a division-type multi-pole connector of the present invention.
Figure 2:
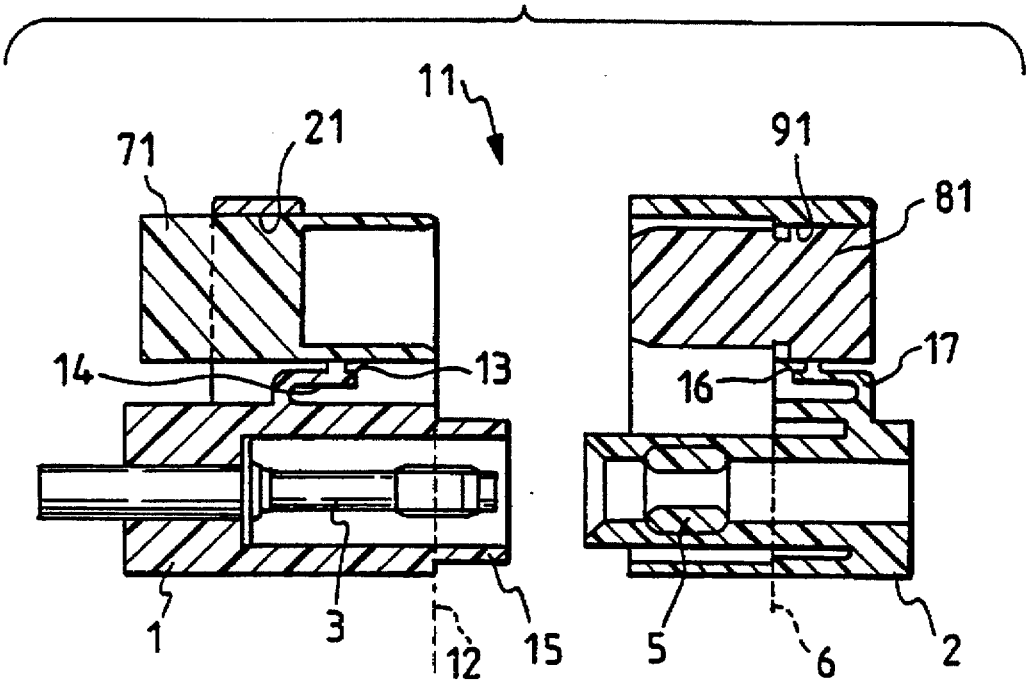
FIG. 2 is a cross-sectional view of an important portion of the connector of FIG. 1, showing a condition before female and male connector housings are fitted together.
Figure 3:
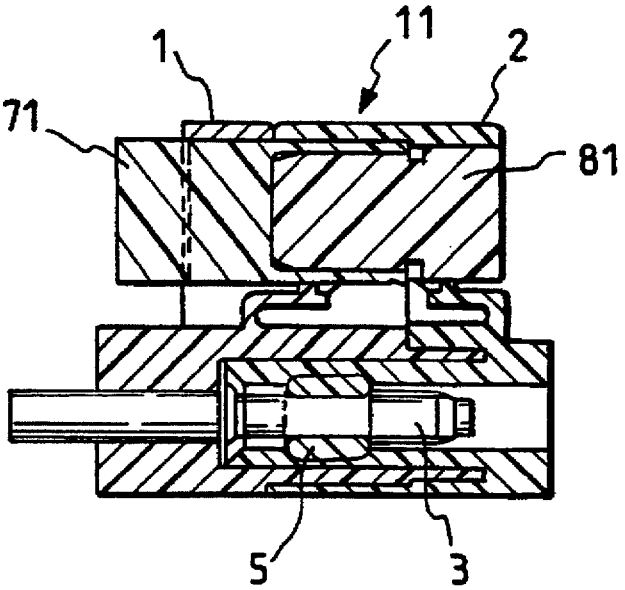
FIG. 3 is a cross-sectional view showing the female and male connector housings of FIG. 2 in a fitted condition.
Figure 4:
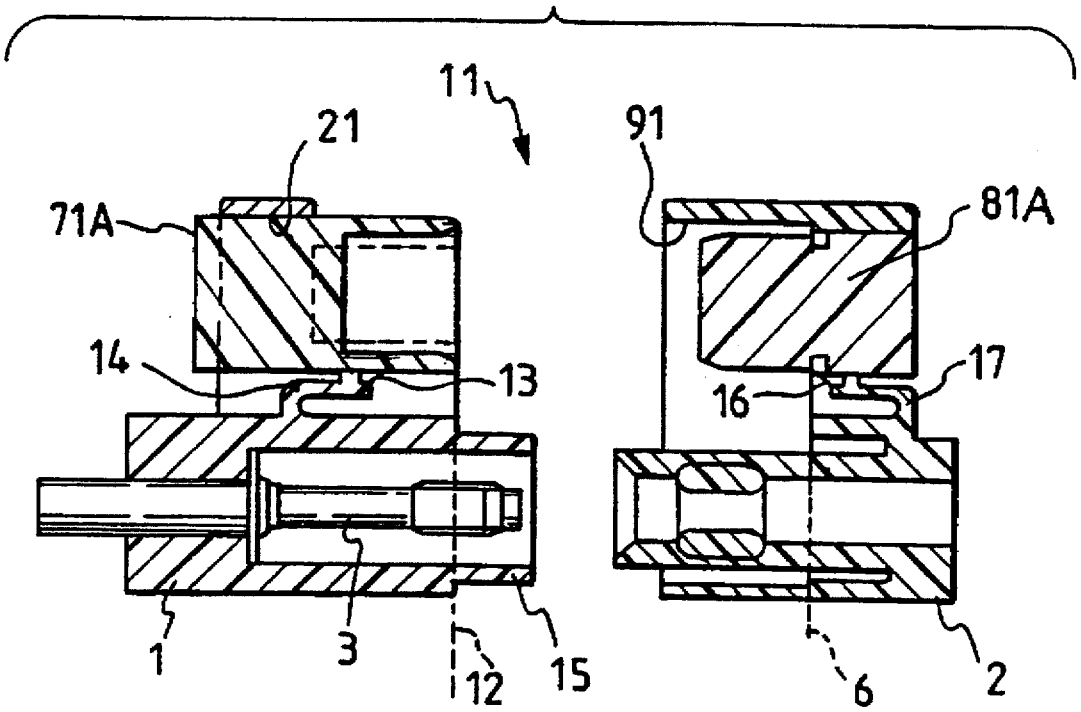
FIG. 4 is a cross-sectional view showing a condition before female and male connector housings, having other type of terminals, are fitted together.
Figure 5:
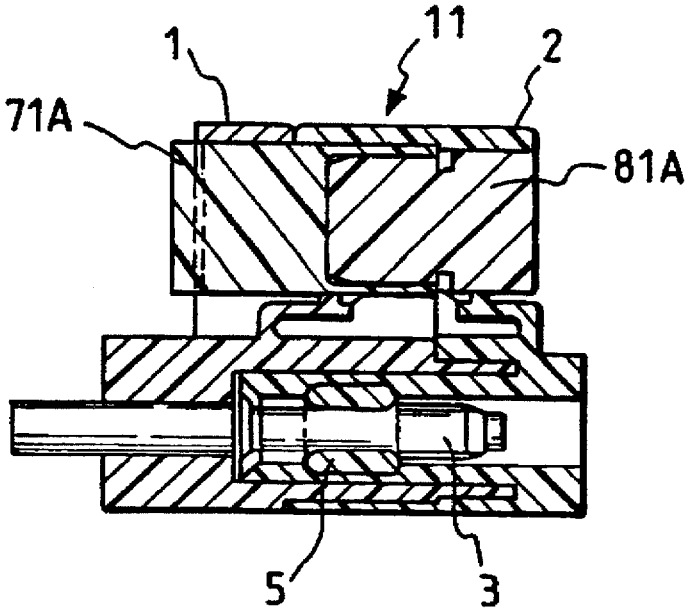
FIG. 5 is a cross-sectional view showing the female and male connector housings of FIG. 4 in a fitted condition.

FIGS. 1 to 5 show one preferred embodiment of the invention, and FIG. 1 is an exploded perspective view showing a general construction of a division-type multi-pole connector, FIG. 2 is a cross-sectional view of an important portion of the division-type multi-pole connector, showing a condition before the fitting is effected, FIG. 3 is a cross-sectional view of an important portion of the division-type multi-pole connector in a fitted condition, FIG. 4 is a cross-sectional view of an important portion of the division-type multi-pole connector of FIG. 1 having other female and male connector housings (having other type of terminals) attached to respective frames, showing a condition before the fitting is effected, and FIG. 5 is a cross-sectional view of an important portion of the division-type multi-pole connector of FIG. 4 in a fitted condition.

In FIG. 1, in this division-type multi-pole connector 11 generally similar in construction to that of the conventional connector, a plurality of kinds of female connector housings 71 and 72 (the other female connector housings are not designated by reference numerals) are attached to one frame 1 (shown at the lower side in FIG. 1) while a plurality of kinds of male connector housings 81 and 82 (the other male connector housings are not designated by reference numerals), corresponding respectively to the above female connector housings 71 and 72, are attached to the other frame 2 (shown at the upper side in FIG. 1).

The one frame 1 has a square tubular portion 15 projected from a central portion thereof, and a fastening bolt 3 is rotatably mounted in this square tubular portion 15 at an axis thereof. A plurality of wide-open cavities 21 and 22 for respectively receiving the female connector housings 71 and 72 are formed around the square tubular portion 15.

The other frame 2 has at its central portion a bolt hole 5 for passing the fastening bolt 3 of the one frame 1 therethrough, and a plurality of wide-open cavities 91 and 92 for respectively receiving the male connector housings 81 and 82 are formed around this bolt hole 5.

A feature of this embodiment is that another female connector housing 71A and another male connector housing 81A (see FIGS. 4 and 5), having other type of terminals, can be mounted respectively in the predetermined cavities 21 and 92 (disposed at the left side in FIG. 1) formed respectively in the frames 1 and 2. Each of these predetermined cavities 21 and 91 have such a large open area that connectors with various poles having other type of terminals can be mounted in the cavity, thus achieving a general-purpose function.

The connectors to be mounted in the predetermined cavities 21 and 91 will now be described in further detail with reference to FIGS. 2 to 5.

FIG. 2 shows a condition in which the female connector housing 71, originally adapted to be mounted in the predetermined cavity 21, is retained on the frame 1, and the male connector housing 81, originally adapted to be mounted in the predetermined cavity 91, is retained on the frame 2. A retaining member for fixing the connector housing to the frame is constituted by retaining projections 13, 16 and elastic retaining arms 14, 17 as described later.

The male connector housing 71 to be attached to the one frame 1 is inserted and fitted into the predetermined cavity 21 from the rear side (left side in FIG. 2) of the frame 1, and the retaining projections 13 formed on the outer surface of the housing are engaged with the elastic retaining arms 14 formed on an inner surface of the cavity 21, thereby retaining the connector housing against rearward withdrawal.

The position of mounting of the female connector housing 71 is such that fitting surfaces 12, provided respectively at the projected end surfaces of this housing and other female housings 72 (see FIG. 1) in the same frame 1, lie in a common plane.

Namely, in order that the female connector housing can be mounted at such a position, the positions of engagement of the retaining projections 13 (formed on the female connector housings 71 and 72) with the associated elastic retaining arms 14 are spaced equidistantly from the fitting surface 12 of the female connector housings 72.

Similarly, the male connector housing 81 to be attached to the other frame 2 is inserted and fitted into the predetermined cavity 91 from the rear side (right side in FIG. 2) of the frame 2, and the retaining projections 16 formed on the outer surface of the housing are engaged with the elastic retaining arms 17 formed on an inner surface of the cavity 91, thereby retaining the connector housing against rearward withdrawal.

The position of mounting of the male connector housing 81 is such that fitting surfaces 6, disposed rearwardly of the projected end surfaces of this housing and other male housings 82 (see FIG. 1) in the same frame 2, lie in a common plane.

Namely, in order that the male connector housing can be mounted at such a position, the positions of engagement of the retaining projections 16 (formed on the male connector housings 81 and 82) with the associated elastic retaining arms 17 are spaced equidistantly from the fitting surface 6 of the male connector housings 82.

With this construction, the one frame 1, having the plurality of kinds of female connector housings 71 and 72 attached thereto, and the other frame 2, having the plurality of kinds of male connector housings 81 and 82 attached thereto, are fastened together by tightening the fastening bolt 3 mounted on the frame 1, so that the male connector housings 81 and 82 are forced into the associated female connector housings 71 and 72, respectively, until the fitting surfaces 6 of the male connector housings 81 and 82 are brought into contact with the fitting surfaces 12 of the female connector housings 71 and 72.

Next, the manner in which another female connector housing 71A, having other type of terminals, and another male connector housing 81A, having other type of terminals, are fitted in the predetermined cavities 21 and 91, respectively, will now be described with reference to FIGS. 4 and 5.

Reference is first made to the another female and male connector housings 71A and 81A to be fitted respectively in the predetermined cavities 21 and 91. In this embodiment, each of these connector housings 71A and 81A receiving the terminals (not shown) of a smaller size is smaller in dimension in the fitting direction (axial direction) than the connector housing shown in FIGS. 2 and 3. However, the outer configuration of each of these connector housings in the direction of the periphery thereof conforms in size to the open area of the associated cavity 21, 91 so that it can be fitted in the cavity 21, 91.

More importantly, each of the female and male connector housings 71A and 81A is mounted in position in the frame 1, 2, respectively, through retaining member in such a manner that the fitting surface 12, 6 of the connector housings 71A and 81A lies in the plane in which the fitting surfaces 12, 6 of the other connector housings 72, 82 lie, as described above for the female and male connector housings 71 and 81.

Therefore, as is clear from the comparison with FIG. 2, the projected end of the female connector housing 71A is disposed as in the female connector housing 71, and instead the rear end surface thereof is almost received in the frame 1. The projected end of the male connector housing 81A is received in the frame 2, and instead the rear end surface thereof is disposed as in the male connector housing 81.

With this construction, when the two frames 1 and 2 are threadedly fastened together as shown in FIG. 5, the two connector housings 71A and 81A are fitted together satisfactorily in the same manner as when the two connector housings 71 and 81 are attached to the frames 1 and 2, respectively.

In the above embodiment, although the fitting surface of the male connector housing is determined in connection with the fitting surface defined by the projected end of the female connector housing, the fitting surface of the female connector housing may be determined in connection with the fitting surface defined by the projected end of the male connector housing.

Figure 6:
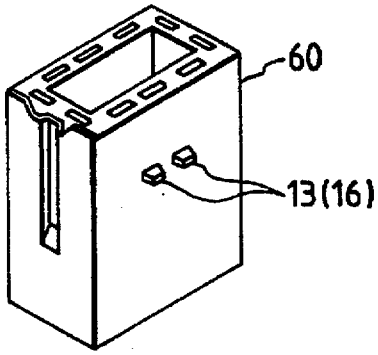
FIG. 6 is a perspective view of an adapter case.
Figure 7:
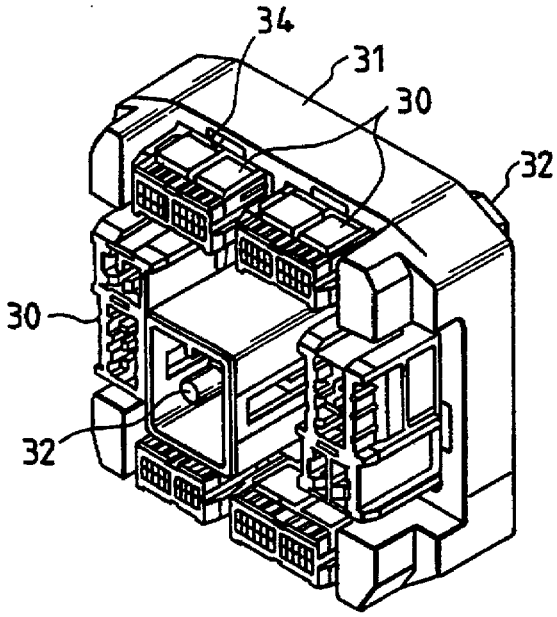
FIG. 7 is a perspective view of a conventional division-type multi-pole connector.
Figure 8:
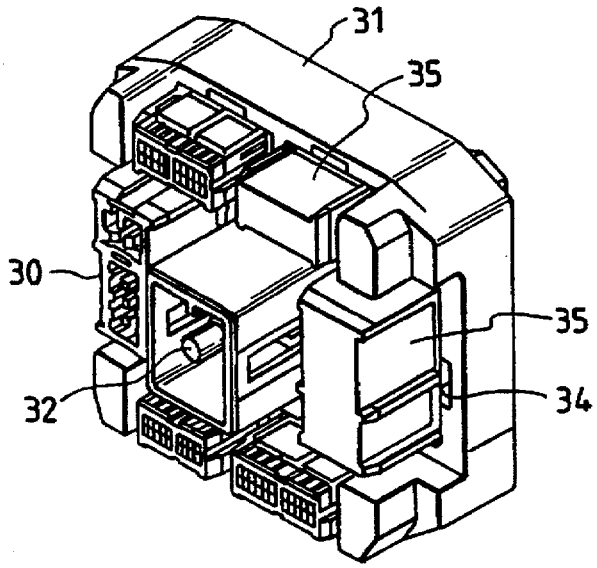
FIG. 8 is a perspective view of a conventional division-type multi-pole connector having dummy connectors attached thereto.

In the above embodiment, although the outer configuration of each of the above-mentioned another connector housings conforms in size to the open area of the associated predetermined cavity so that the connector housing can be fitted in the predetermined cavity, there can be adopted an arrangement in which an adapter case 60 (see FIG. 6) of a square tubular configuration conforming in size to the open area of the cavity, is used, and a female connector (male connector) of a smaller size is fitted in this adapter case 60, and then this adapter case is attached to the frame. Even in such an arrangement, the retaining projections 13 (16) must be provided on an outer surface of the adapter case in such a manner that when the connector is mounted in position in the frame, the fitting surface thereof lies in the plane in which the fitting surfaces of the other connectors lie.

As described above, the plurality of kinds of female connector housings are mounted in the one frame in such a manner that their fitting surfaces lie in the common plane, and the plurality of male connector housings, corresponding respectively to the female connector housing, are mounted in the other frame in such a manner that their fitting surfaces lie in the common plane, and the retaining member for the male an female connector housings is disposed a predetermined distance from the fitting surfaces. Therefore, the connector housings can be mounted in an interchangeable manner in the same frame, and other type of connector housing can be mounted easily.

With this construction, for example, where the connector, used in a high-grade car, is not used in a low-grade car, so that a certain cavity is empty, the connector for other circuitry can be mounted in this empty cavity in an interchangeable manner, thereby enhancing the bundling of wire harnesses at the connector connection portion, and besides the use of dummy connectors heretofore used can be omitted.

Furthermore, the formation of a mold for a new frame for the purpose of avoiding an empty cavity is not necessary, and thus it is not necessary to provide a series of frames, which reduces the cost.

What is claimed is:

1. A division-type multi-pole connector, comprising:

a first frame including cavities accommodating female connector housings of different types;

a second frame including cavities accommodating male connector housings of different types corresponding respectively to said female connector housings; and retaining means for retaining each of said female connector housings and said male connector housings in said cavities, wherein said retaining means are so provided as to position each fitting surface of said female connector housings in a common plane when said female connector housings are mounted in said first frame, and wherein said retaining means are also provided to as to position each fitting surface of said male connector housings in a common plane when said male connector housings are mounted in said second frame, said fitting surfaces of said female connector housings abutting said fitting surfaces of said male connector housings, respectively.

2. The division-type multi-pole connector of claim 1, wherein said retaining means are disposed at a predetermined distance from said fitting surface.

3. The division-type multi-pole connector of claim 2, wherein said retaining means include a retaining projection and an elastic retaining arm.

4. The division-type multi-pole connector of claim 3, wherein said retaining projection is formed on outer surface of said connector housings, and said elastic retaining arm is formed on inner surface of said cavities.

5. The division-type multi-pole connector of claim 1, wherein at least one of said cavities of said first frame and one of said cavities of said second frame corresponding thereto are able to accommodate a shortened female connector housing and a shortened male connector housing, respectively.

6. The division-type multi-pole connector of claim 5, wherein said shortened connector housings are smaller in dimension in a fitting direction than connector housings being predetermined to mount in said cavities accommodating said shortened connector housings, respectively.

7. The division-type multi-pole connector of claim 5, wherein said cavities, which accommodate respectively said shortened connector housings, have a larger opening than the other cavities.

8. The division-type multi-pole connector of claim 1, wherein said male and female connector housings include distal end faces and wherein said distal end faces of said male connector housings are staggered with respect to one another in a longitudinal direction of the male connector housings and wherein said distal end faces of said female connector housings are staggered with respect to one another in a longitudinal direction of said female connector housings.

9. The division-type multi-pole connector of claim 1, wherein the overall length of said female connector housings differ from each other and wherein the overall length of said male connector housings differ from each other.

10. A division-type multi-pole connector, comprising:

a first frame including cavities accommodating female connector housings;

a second frame including cavities accommodating male connector housings corresponding respectively to said female connector housings; and retaining means for retaining each of said female connector housings and said male connector housings in said cavities, wherein said retaining means are so provided as to position each fitting surface of said female connector housings in a common plane when said female connector housings are mounted in said first frame, and wherein said retaining means are also provided to as to position each fitting surface of said male connector housings in a common plane when said male connector housings are mounted in said second frame, wherein at least one of said cavities of said first frame and one of said cavities of said second frame corresponding thereto are able to accommodate a shortened female connector housing and a shortened male connector housing, respectively, wherein each of a smaller size female connector housing and a smaller size male connector housing is received in an adapter case, and said adapter case is accommodated in said cavities.

* * * * *